US010124922B2

(12) United States Patent
Pfeffer et al.

(10) Patent No.: US 10,124,922 B2
(45) Date of Patent: Nov. 13, 2018

(54) LABELLING MACHINE AND METHOD OF CONTROLLING THE SPEED OF A LABEL WEB

(71) Applicant: VIDEOJET TECHNOLOGIES INC., Wood Dale, IL (US)

(72) Inventors: Gary Pfeffer, Nottingham (GB); Philip Hart, Nottinghamshire (GB); Jeremy Ellis, Notttinghamshire (GB)

(73) Assignee: VIDEOJET TECHNOLOGIES, INC., Wood Dale, IL (US)

( * ) Notice: Subject to any disclaimer, the term of this patent is extended or adjusted under 35 U.S.C. 154(b) by 234 days.

(21) Appl. No.: 14/901,811

(22) PCT Filed: Oct. 16, 2014

(86) PCT No.: PCT/GB2014/053106

§ 371 (c)(1),
(2) Date: Dec. 29, 2015

(87) PCT Pub. No.: WO2015/059450

PCT Pub. Date: Apr. 30, 2015

(65) Prior Publication Data

US 2016/0368648 A1 Dec. 22, 2016

Related U.S. Application Data

(60) Provisional application No. 61/840,270, filed on Jun. 27, 2013.

(30) Foreign Application Priority Data

Oct. 21, 2013 (GB) ..... 1318583.0

(51) Int. Cl.
*B65C 9/42* (2006.01)
*B65C 9/08* (2006.01)

(52) U.S. Cl.
CPC . *B65C 9/42* (2013.01); *B65C 9/08* (2013.01)

(58) Field of Classification Search
CPC ..... B29C 9/40; B29C 9/42; B29C 2009/402; B29C 2009/404
(Continued)

(56) References Cited

U.S. PATENT DOCUMENTS 4,267,004 A 5/1981 Anderson
2001/0054470 A1 12/2001 Firehammer
(Continued)

FOREIGN PATENT DOCUMENTS

JP 2005193924 7/2005
WO 199604559 12/1996

*Primary Examiner* — George R Koch
(74) *Attorney, Agent, or Firm* — Beusse, Wolter, Sanks & Maire PLLC

(57) ABSTRACT

A labelling machine comprises a supply spool support for supporting a spool of label carrying web, a take up spool support adapted to take up a portion of web, and a first motive apparatus for transporting web along a web path between the supply spool support to the take up spool support, and a controller. The controller is configured to provide a control signal to the first motive apparatus, wherein the controller is further configured such that the controller provides a control signal to the first motive apparatus to accelerate the first motive apparatus between a first speed and a second speed by providing a control signal to the first motive apparatus to command the first motive apparatus to accelerate to a predetermined first intermediate speed intermediate the first and second speeds, then a control signal to command the first motive apparatus to accelerate to a second predetermined intermediate speed intermediate the first intermediate speed and the second speed, and then a control signal to command the first motive apparatus to accelerate to the second speed.

16 Claims, 6 Drawing Sheets

(58) Field of Classification Search
USPC ..... 156/64, 367, 368
See application file for complete search history.

(56) References Cited

U.S. PATENT DOCUMENTS

| | | | |
|---|---|---|---|
| 2002/0096264 | A1 | 7/2002 | Yang |
| 2003/0034111 | A1 | 2/2003 | Oldenburg |
| 2006/0289106 | A1 | 12/2006 | Thiel |
| 2011/0048608 | A1 | 3/2011 | Dods |

LABELLING MACHINE AND METHOD OF CONTROLLING THE SPEED OF A LABEL WEB

This application is a 371 of PCT/GB2014/053106, filing date Oct. 16, 2014.

The present invention relates to a labelling machine and particularly to a labelling machine for use with label web comprising a web and a plurality of labels attached to the web and which are separable from the web. Such machines are sometimes referred to as "roll-fed self-adhesive labelling machines". The present invention also relates to a method of operating a labelling machine.

A label stock comprising a web carrying labels is usually manufactured and supplied as a wound roll (hereinafter referred to as a spool). For a given spool, all the labels are typically the same size, within manufacturing tolerances. However, in some instances, this is not the case.

Labels are commonly used to display information relating to an article and are commonly disposed on the article such that the information is easily readable either manually or automatically. Such labels may, for example, display product information, barcodes, stock information or the like. Labels may be adhered to a product or to a container in which the product is packaged.

In the manufacturing industry, where such labels are read automatically, it is important for the information to be printed such that it is clear and positioned accurately so that an automated reader can consistently and correctly read the information.

Some known labelling machines apply pre-printed labels to an article. Other known labelling machines print information onto labels immediately before printed labels are applied to an article. Such labelling machines may be referred to as print and apply labelling machines.

It is desirable to be able to advance a web of labels to be applied to an article accurately, so as to ensure that print is accurately positioned on the label and/or to ensure that the label is accurately positioned on the article. This may be particularly important in print and apply labelling machines in which printing is typically carried out while the label moves relative to the printhead, making accurate control of the label (and hence the label web) important if printing is to be properly carried out such that the desired information is correctly reproduced on the label.

Given that labels are often removed from the moving web by passing the label web under tension around a labelling peel beak (sometimes referred to as a peel beak, a peel blade or a label separating beak), it is sometimes desirable to ensure that a predetermined optimum tension in the web of the label web is maintained. In some applications, it is also desirable that the label web can be moved at a predetermined speed of travel along a defined web path, so as to ensure that the speed at which labels are dispensed is compatible with the speed at which products or containers move along a path adjacent the device.

It is therefore desirable in the manufacturing industry for there to be means and a method for transporting a label web and applying labels from the web of the label web to a product or container, which is accurate, reliable, simple to use and adaptable to different applications.

The advancement of the label web is generally effected by a motive apparatus. Accurate advancement of the label web requires accurate control of the motive apparatus. Such accurate control of the motive apparatus so as to accurately position the label web has been difficult to achieve in known labelling machines.

It is an object of embodiments of the present invention to obviate or mitigate one or more of the problems of known labelling machines whether set out above or otherwise, and/or to provide an alternative labelling machine.

According to an aspect of the invention there is provided a labelling machine comprising a supply spool support for supporting a spool of label carrying web, a take up spool support adapted to take up a portion of web, and a first motive apparatus for transporting web along a web path between the supply spool support to the take up spool support, and a controller configured to provide a control signal to the first motive apparatus, wherein the controller is further configured such that the controller provides a control signal to the first motive apparatus to accelerate the first motive apparatus between a first speed and a second speed by providing a control signal to the first motive apparatus to command the first motive apparatus to accelerate to a predetermined first intermediate speed intermediate the first and second speeds, then a control signal to command the first motive apparatus to accelerate to a second predetermined intermediate speed intermediate the first speed and the second speed, and then a control signal to command the first motive apparatus to accelerate to the second speed.

According to an aspect of the present invention there is provided a labelling machine comprising a supply spool support for supporting a spool of label carrying web, a take up spool support adapted to take up a portion of web, and a first motive apparatus for transporting web along a web path between the supply spool support to the take up spool support, and a controller configured to provide a control signal to the first motive apparatus, wherein the controller is further configured such that the controller provides a control signal to the first motive apparatus to accelerate the first motive apparatus between a first speed and a second speed by providing a control signal to the first motive apparatus to command the first motive apparatus to accelerate to a predetermined first intermediate speed intermediate the first and second speeds, then a control signal to command the first motive apparatus to accelerate to a second predetermined intermediate speed intermediate the first intermediate speed and the second speed, and then a control signal to command the first motive apparatus to accelerate to the second speed.

By accelerating the first motive apparatus between the first and second speeds via first and second intermediate speeds, the likelihood that (or the extent to which) the speed of the first motive apparatus will undesirably exceed the second speed as a result of the acceleration is reduced. This will be advantageous in applications of labeling machine in which it is desirable to be able to accurately position the label web along the label web path. This may be advantageous to enable accurate positioning of a label onto an article to which a label is applied and, if the labelling machine includes a printer, ensuring that not only the printer prints on the correct portion of the label, but also ensuring acceptable print quality. Furthermore, if the labelling machine includes a printer with print ribbon (such as, for example a thermal transfer printer), the invention may allow the motion of the label stock to more closely match that of the print ribbon, thereby improving print quality.

In some embodiments, the second predetermined intermediate speed may not be intermediate the first intermediate speed and the second speed. For example, the second predetermined intermediate speed may be less than the first predetermined intermediate speed. Furthermore, in some embodiments, at least one of the first and second intermediate speeds may be less than the first speed. It follows that the first and second predetermined intermediate speeds may be any appropriate speed.

The controller may be configured to command the first motive apparatus to accelerate to the first intermediate speed for a first time period, the controller may be configured to command the first motive apparatus to accelerate to the second intermediate speed for a second time period, and the controller may be configured to command the first motive apparatus to accelerate to the second speed for a third time period.

The first and second predetermined intermediate speeds may be defined as a proportion of the second speed.

The first and second intermediate speeds may be defined as the first speed plus a proportion of the difference between the first and second speeds.

The first time period and/or second time period may be a predetermined time.

The labelling machine may further include an encoder configured to produce a sensor signal indicative of the speed of the label web along the web path, and wherein the first time period and/or second time period and/or third time period may be ended when the controller receives a sensor signal from the encoder that indicates that the speed of the label web is a respective predetermined speed.

The encoder may be configured to monitor rotation of a roller which defines a portion of the label web path.

The labelling machine may include a printer comprising a printhead which is configured to press the label web against a print roller to effect printing, and the encoder may be configured to monitor the rotation of the print roller.

The respective predetermined speed may be defined as a proportion of the second speed.

The respective predetermined speed may be defined as the first speed plus a proportion of the difference between the first and second speeds.

The acceleration during the first time period may be a predetermined acceleration. The acceleration during the second time period may be a predetermined acceleration. The acceleration during the third time period may be a predetermined acceleration.

The acceleration during the first time period may be determined by the controller based on the first speed and the first intermediate speed.

The acceleration during the second time period may be determined by the controller based on the first intermediate speed and the second intermediate speed.

The acceleration during the second time period may be determined by the controller based on the first intermediate speed and the second intermediate speed.

According to another aspect of the invention there is provided a method of controlling a labelling machine, the labelling machine comprising a supply spool support, a take up spool support, a first motive apparatus and a controller, the method comprising: the supply spool support supporting a spool of label carrying web, the take up spool support taking up a portion of the web, the first motive apparatus transporting web along a web path between the supply spool support to the take up spool support, the controller providing a control signal to the first motive apparatus to accelerate the first motive apparatus between a first speed and a second speed by: providing a control signal to the first motive apparatus to command the first motive apparatus to accelerate to a predetermined first intermediate speed intermediate the first and second speeds, then providing a control signal to command the first motive apparatus to accelerate to a second predetermined intermediate speed intermediate the first intermediate speed and the second speed, and then providing a control signal to command the first motive apparatus to accelerate to the second speed.

According to another aspect of the invention there is provided a labelling machine comprising: a supply spool support for supporting a spool of label carrying web, a take up spool support adapted to take up a portion of web, and a first motive apparatus for transporting web along a web path between the supply spool support and the take up spool support, and an encoder configured to produce a sensor signal indicative of the position of the label web along the web path, a controller configured to provide a control signal to the first motive apparatus; wherein the controller is further configured such that the controller provides a control signal to the first motive apparatus to decelerate the label web from a first speed to rest, such that the web stops at a desired position along the web path, by providing a control signal to the first motive apparatus to decelerate the first motive apparatus between the first speed and rest, such that at rest the label web is located at an intermediate position along the web path, waiting for a period of time and then, based on the sensor signal produced by the encoder, the controller providing a control signal to the first motive apparatus to move the web along the web path by a correction amount to position the web at said desired position along the web path.

Decelerating the label web to rest at a position other than the desired position and then subsequently moving the label web by a correction amount to position the web at the desired position will be advantageous in applications of labeling machine in which it is desirable for the label web, after a labelling operation, to be located at the desired position in order to indicate that the labelling machine is operating correctly. By decoupling the deceleration and locating the label web at the desired position along the label web path, this provides more freedom to carry out decelerations having a range of parameters (e.g. start/stop time/position of deceleration, duration of deceleration, rate of deceleration etc.), whilst still being able to finally position the label web at the desired position, thereby indicating correct operation of the labelling machine.

The encoder may be configured to monitor rotation of a roller which defines a portion of the label web path.

The labelling machine may include a printer comprising a printhead which is configured to press the label web against a print roller to effect printing. The encoder may be configured to monitor the rotation of the print roller.

The desired position of the web along the label web path may be a position at which a portion of a label of the label web is substantially located at a portion of a labelling station, the labelling station being configured to separate labels of the label web from a backing web portion of the label web as the label web passes the labelling station. The labelling station may include a labelling peel beak and the desired position of the web along the label web path may be a position at which an edge of a label of the label web is substantially located at an edge of a label peel beak. In other embodiments the label portion may not be an edge of the label, but any appropriate portion of a label. In addition the portion of the labelling station need not be the edge of a labelling peel beak, but may be any other appropriate portion of the labelling station and/or peel beak.

The controller may be configured to determine the correction amount by using the sensor signal to determine the distance between the intermediate position and the desired position.

The controller may be configured to control the first motive apparatus to advance the label web by the correction distance at a predetermined speed.

The controller may be configured such that the intermediate position is spaced along the label web path from the desired position by a predetermined distance.

The controller may be configured such that if a subsequent labelling operation is requested prior to the first motive apparatus moving the web along the web path by the correction amount, the controller cancels moving the web along the web path by the correction amount and carries out the subsequent labelling operation.

This may help to increase the throughput of the labelling machine.

"Prior to the first motive apparatus moving the web along the web path by the correction amount" may encompass both i) before the first motive apparatus causes any movement of the web along the web path by the correction amount and ii) before the first motive apparatus has completed movement of the web along the web path by the correction amount (i.e. at a time during the first motive apparatus causing movement of the web along the web path by the correction amount).

The controller may be configured such that, whilst carrying out the subsequent labelling operation, the correction amount is added to the movement required by the label web for the subsequent labelling operation.

In the case where a subsequent labelling operation is requested before the first motive apparatus causes any movement of the web along the web path by the correction amount, the correction amount which is added to the movement required by the label web for the subsequent labelling operation may be the entire correction amount that was intended to be utilised for the labelling operation before the subsequent labelling operation was requested.

In the case where a subsequent labelling operation is requested at a time during the first motive apparatus causing movement of the web along the web path by the correction amount, the correction amount which is added to the movement required by the label web for the subsequent labelling operation may be a remaining correction amount. The remaining correction amount may be the portion of the correction amount of the labelling operation remaining at the time the subsequent labelling operation is requested.

The labelling machine may further include a product sensor for sensing the presence of a product to be labelled. The controller may be configured to commence a labelling operation after waiting a registration delay based upon a time at which a signal is received from the product sensor indicative of the presence of a product to be labelled.

The registration delay may be a time and the controller may be configured to modify the registration delay for the subsequent labelling operation such that the registration delay is reduced by a time equivalent to the time required to move the web along the web path by the correction amount added to the subsequent labelling operation.

The registration delay may be a distance and the controller may be configured to modify the registration delay for the subsequent labelling operation such that the registration delay is reduced by a distance equivalent to the correction amount to be moved by the web along the web path added to the subsequent labelling operation.

By modifying the registration delay it is possible for the labelling machine to commence a labelling operation sooner with regards to the time at which the product sensor senses a product to be labelled. This may enable the labelling machine to complete the portion of the subsequent labelling operation which is the movement of the web along the web path by the correction amount before the remaining portion of the subsequent labelling operation. As such, the remaining portion of the subsequent labelling operation (e.g. the portion of the subsequent labelling operation which does not include the correction amount) may commence at a time and/or distance which is equivalent to the registration delay if it had not been modified. This may help to further increase the throughput of the labelling machine.

According to another aspect of the invention there is provided a method for controlling a labelling machine, the labelling machine comprising a supply spool support, a take up spool support, a first motive apparatus, an encoder and a controller, the method comprising: the supply spool support supporting a spool of label carrying web, the take up spool support taking up a portion of web, the first motive apparatus transporting web along a web path between the supply spool support and the take up spool support, and the encoder producing a sensor signal indicative of the position of the label web along the web path, the controller providing a control signal to the first motive apparatus to decelerate the label web from a first speed to rest, such that the web stops at a desired position along the web path, by providing a control signal to the first motive apparatus to decelerate the first motive apparatus between the first speed and rest, such that at rest the label web is located at an intermediate position along the web path, waiting for a period of time, and based on the sensor signal produced by the encoder, providing a control signal to the first motive apparatus to move the web along the web path by a correction amount to position the web at said desired position along the web path.

According to another aspect of the invention there is provided a labelling machine comprising: a supply spool support for supporting a spool of label carrying web, a take up spool support adapted to take up a portion of web, and a first motive apparatus for transporting web along a web path between the supply spool support to the take up spool support, and a controller configured to provide a control signal to the first motive apparatus, wherein the controller is further configured such that the controller controls the first motive apparatus to advance the web along the web path a predetermined distance by providing a control signal to the first motive apparatus which causes the first motive apparatus to advance the web along the web path by a distance which is less than the predetermined distance and wherein relaxation of the web after the web has been advanced along the web path by the first motive apparatus results in the web advancing along the web path a further distance.

This will be advantageous in applications of labeling machine in which it is desirable to be able to accurately position the label web along the label web path. By stopping the advancement of the label web along the web path due to motion of the first motive apparatus at a position before the desired (predetermined) position and allowing the label web to relax so that it moves towards the desired (predetermined) position, this will allow more accurate positioning of the label web because it obviates or ameliorates the effect that label web lag has on the positioning of the label web and hence reduces or prevents advancement of the label web too far along the label web path due to label web lag. This may be advantageous to enable accurate positioning of a label onto an article to which a label is applied and, if the labelling machine includes a printer, ensuring that not only the printer prints on the correct portion of the label, but also ensuring acceptable print quality.

The labelling machine may further include a label sensor to detect a portion of a label of the label web. The controller may be configured to control the first motive apparatus to advance the web along the web path said predetermined distance when the label sensor detects said portion of a label of the label web.

The label sensor may be a gap sensor which detects an edge of a label of the label web.

The control signal provided to the first motive apparatus, which causes the first motive apparatus to advance the web along the web path by a distance which is less than the predetermined distance, may cause the first motive apparatus to advance the web along the web path by a distance which is determined by the controller such that the distance determined by the controller plus said further distance is substantially equal to said predetermined distance.

The distance which is less than the predetermined distance may be determined by the controller by subtracting an estimated lag distance from said predetermined distance.

The estimated lag distance may be a predetermined distance.

The estimated lag distance may be determined by the controller based on at least one operating characteristic of the labelling machine.

The at least one operating characteristic of the labelling machine may include at least one of the diameter of the take up spool and the speed at which a label web is advancing along the label web path.

The labelling machine may further include an encoder configured to produce a sensor signal indicative of the position of the label web along the web path. The controller may determine the estimated lag distance based on the sensor signal indicative of the position of the label web along the label web path output by the encoder.

The controller may be configured to monitor the sensor signal and determine a lag distance moved by the label web after the first motive apparatus has come to rest for a previous movement of the label web. The controller may be configured to use the determined lag distance as the estimated lag distance.

The controller may be configured to monitor the sensor signal and determine lag distances moved by the label web after the first motive apparatus has come to rest for a succession of previous movements of the label web. The controller may further be configured to determine an average of the lag distances of said succession of previous movements of the label web and use the determined average as the estimated lag distance.

In order to determine a lag distance moved by the label web after the first motive apparatus has come to rest for a previous movement of the label web, the controller may be configured to, based on the sensor signal, compare the position of the label web along the web path at a time when the first motive apparatus has come to rest and the position of the label web along the web path at a predetermined time after the time when the first motive apparatus has come to rest.

According to another aspect of the invention there is provided a method of controlling a labelling machine, the labelling machine comprising a supply spool support, a take up spool support, a first motive apparatus and a controller, the method comprising: the supply spool support supporting a spool of label carrying web, the take up spool support taking up a portion of the web, the first motive apparatus transporting web along a web path between the supply spool support to the take up spool support, the controller providing a control signal to the first motive apparatus, the controller controlling the first motive apparatus to advance the web along the web path a predetermined distance by providing a control signal to the first motive apparatus which causes the first motive apparatus to advance the web along the web path by a distance which is less than the predetermined distance; and allowing relaxation of the web after the web has been advanced along the web path by the first motive apparatus in order that the web advances along the web path a further distance.

The first motive apparatus may include a stepper motor. The stepper motor may be configured to rotate the take up spool support.

A method according to any of the previously described aspects of the invention may have any of the features of a labelling machine according to any of the previously described aspects of the invention.

According to another aspect of the invention there is provided a computer program comprising computer readable instructions arranged to carry out a method according any of the previous aspects of the invention.

According to a further aspect of the invention there is provided a computer readable medium carrying a computer program according to the previous aspect.

It will be appreciated that features discussed in the context of one aspect of the invention can be applied to other aspects of the invention. In particular, where features are described as being carried out by the controller in the aspects of the invention relating to a labelling machine, it will be appreciated that such features can be used in combination with and applied in aspects of the invention which relate to a method of controlling a labelling machine.

The methods described in any of the aspects of the invention above can be carried out in any convenient way. In particular the method may be carried out by a controller and such a controller is therefore provided by the invention. The controller may be provided by any appropriate hardware elements. For example the controller may be microcontroller which reads and executes instructions stored in a memory, the instructions causing the controller to carry out a method as described herein. Alternatively the controller may take the form of an ASIC of FPGA.

An embodiment of the invention will now be described, by way of example, with reference to the accompanying drawings, in which:

FIG. 1 is a perspective view of a print and apply labelling machine in accordance with the present invention, including a printer;

FIG. 1*a* is a schematic view of a motive means of the labelling machine shown in FIG. 1;

Figure 1:
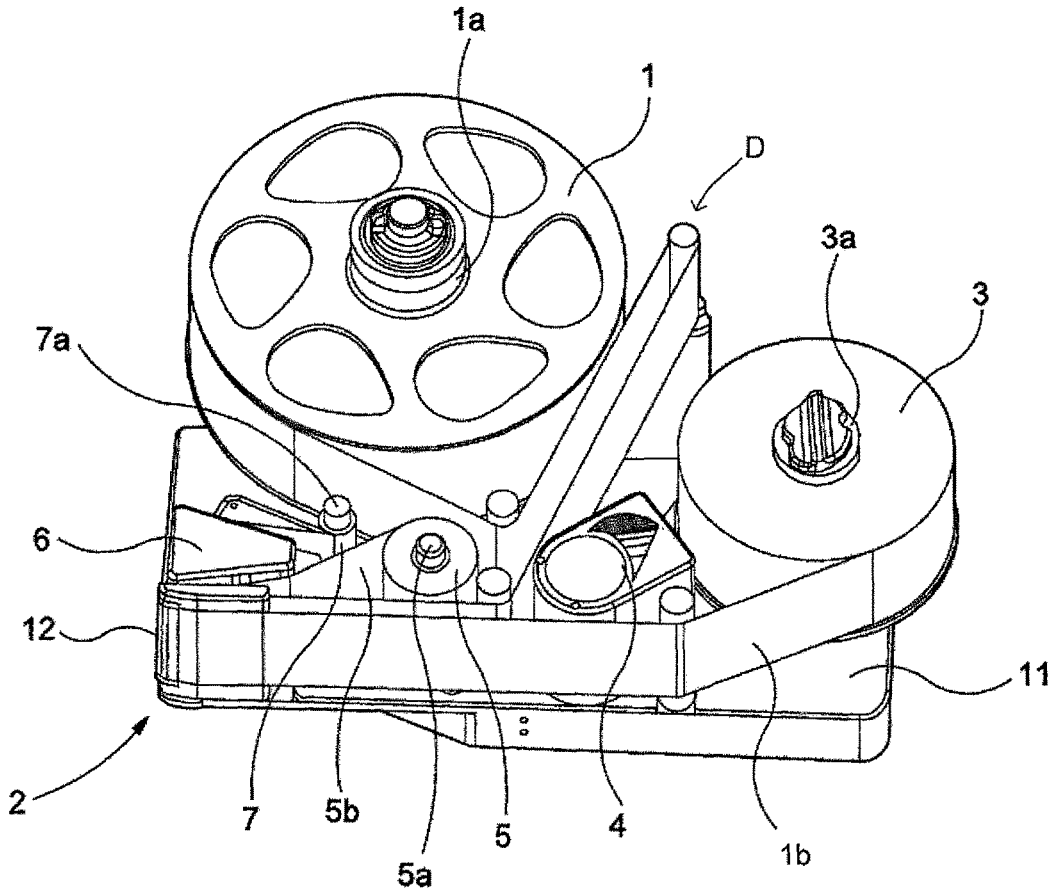
Figure 1A:
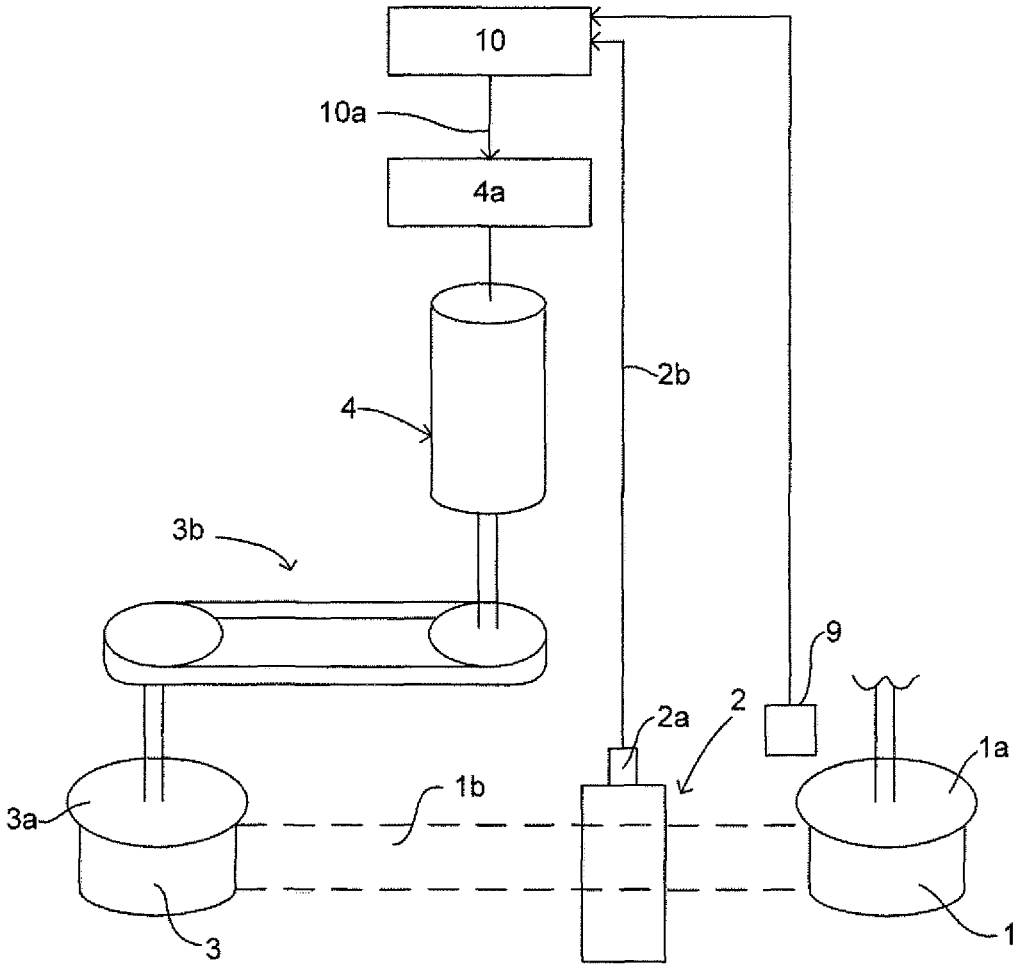

Referring to FIGS. 1 and 1*a*, there is illustrated a print and apply labelling machine in which label web material is provided as a label supply spool 1 supported by a supply spool support 1*a* and is conveyed through a labelling station 2 to a label take up spool 3 supported by a take up spool support 3*a*. The label web material comprises a plurality of labels (not shown) which are affixed to a backing paper (or backing web) and the labelling station is arranged to remove labels from the backing paper such that the labels are affixed to packages which are conveyed past the labelling station 2. The backing paper is then taken up onto the label take up spool 3.

A motor 4 is coupled to the label take up spool 3 via a belt drive 3*b* thereby causing rotation of the take up spool 3 and consequently movement of the label web from the label supply spool 1 to the label take up spool 3 through the labelling station 2.

In the present embodiment the motor 4 constitutes a first motive apparatus for transporting web along a web path between the supply spool support to the take up spool support. For example, in other embodiments the first motive apparatus may take any appropriate form. For example, in some embodiments both the label supply spool 1 and the label take up spool 3 may be driven either by the same motor or by respective motors.

In the present embodiment the motor 4 is a stepper motor. The stepper motor is driven by a stepper motor driver (also referred to as a stepper motor drive circuit) 4*a*, as is well known in the art. In other embodiments the motor(s) driving the label take up spool 3 (and, in some cases, the label supply spool) may be motors other than stepper motors. For example the motor(s) may be direct current (DC) motor(s). In general, the motor(s) may be torque controlled motors (e.g. DC motors) or position controlled motors (e.g. stepper motors, or DC servo motors). In addition, depending on what type of motor(s) is/are used, it would be apparent to the person skilled in the art that an appropriate motor drive control system will be required.

The labelling station 2 includes a thermal transfer printer which is arranged to print on labels of the label web as they pass through the labelling station 2 and before they are removed from the backing paper. Further details of the thermal transfer printer are discussed below.

Ink carrying ribbon 5*b* is provided on a ribbon supply spool 5 which is supported by a ribbon supply spool support 5*a*. The ribbon 5*b* passes a printhead assembly 6 and is taken up by a ribbon take-up spool 7 which is supported by a ribbon take-up spool support 7*a*. The ribbon supply spool 5 is driven by a first stepper motor (not shown) while the ribbon take-up spool 7 is driven by a second stepper motor (again not shown). In the illustrated embodiment the ribbon supply spool support 5*a* is mounted on an output shaft of the first stepper motor, while the ribbon take-up spool support 7*a* is mounted on an output shaft of the second stepper motor. The first and second stepper motors may be arranged so as to operate in push-pull mode whereby the first stepper motor rotates the ribbon supply spool 5 to pay out ribbon while the second stepper motor rotates the ribbon take-up spool 7 so as to take up tape. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

In other embodiments the ribbon may be transported from the ribbon supply spool 5 to the ribbon take up spool 7 passed the printhead assembly 6 in other ways. For example only the ribbon take up spool may be driven by a motor while the ribbon supply spool 5 is arranged so as to provide resistance to ribbon motion, thereby causing tension in the ribbon. That is, the first motor driving the ribbon supply spool 5 may not be required in some embodiments. In some embodiments the motors driving the ribbon supply spool 5 and the ribbon take up spool 7 may be motors other than stepper motors. For example the motors driving the ribbon supply spool 5 and the ribbon take up spool 7 may be direct current (DC) motors. In general the motors driving the ribbon supply spool 5 and/or the ribbon take up spool 7 may be torque controlled motors (e.g. DC motors) or position controlled motors (e.g. stepper motors, or DC servo motors). In addition, depending on what type of motor(s) is/are used, it would be apparent to the person skilled in the art that an appropriate motor drive control system will be required.

The printhead assembly 6 comprises a printhead (not shown) which presses the ribbon 5*a* and label web 1*b* against a print roller (not shown) to effect printing. The printhead is a thermal transfer printhead comprising a plurality of printing elements, each arranged to remove a pixel of ink from the ribbon and to deposit the removed pixel of ink on a substrate (in this case labels which form part of the label web).

The labelling station 2 is configured to separate labels of the label web from the backing web as the label web passes the labelling station. The separated labels may then be applied to an article which passes the labelling machine. In this embodiment the labelling station includes a labelling peel beak 12. The labelling peel beak 12 is configured such that, during operation of the labelling machine, as the label web 1*b* is transported along the web path past the labelling peel beak 12, the labelling peel beak 12 separates passing labels of the label web 1*b* from the backing web. In other embodiments the labelling peel beak may be replaced by any appropriate component configured to separate passing labels of the label web from the backing web.

The labelling station, take up spool support, supply spool support first motive apparatus and printer are mounted to a baseplate 11.

The labelling machine also includes an encoder 2*a* which is arranged to output a sensor signal 2*b* which is indicative of the position of the label web along the label web path. The sensor signal may also be used to determine a rate of movement of the label web along the label web path. In some embodiments, the determination of a rate of movement of the label web along the label web path may be made by a controller 10 to which the sensor signal 2*b* is provided. In other embodiments, the determination of a rate of movement of the label web along the label web path may be made by the encoder itself and a signal indicative thereof provided to the controller. The rate of movement of the label web may be a speed of the label web, an acceleration of the label web, an amount of movement of the label web during a given time, or the time taken for the label web to move a predetermined distance along the web path.

In this particular embodiment the encoder monitors rotation of the print roller. In some embodiments the print roller comprises an aluminium shaft of diameter 8 mm and is coated with a non-slip coating. In one embodiment, the non-slip coating is a silicon rubber coating having a Shore A hardness of 50-55 and a thickness of 2.75 mm. The primary purpose of the print roller is to provide a backing support against which the printhead presses the ribbon and label web so as to effect thermal transfer printing onto a label. As such, the print roller acts as platen roller. The provision of a non-slip coating has the effect of ensuring that there is substantially no slippage between the print roller and the label web. Consequently, the print roller rotates consistently as the label web moves along the web path. This means that the rotation of the print roller is an accurate indicator of label web movement. Rotation of the print roller may be used in processing carried out by the controller in order to determine a rate of movement of the label web in the manner described below.

In some embodiments the diameter of the print roller is known to the controller. In one embodiment the print roller has a diameter of 13.5 mm. It is preferable that the print roller has as small a moment of inertia as possible, and it is for this reason that the shaft is made from aluminium. Because the diameter of the print roller is known, and because the label web runs over the print roller as the label web passes through the printer, the amount of rotation of the print roller is proportional to the displacement of the label web along the label web path. Consequently, a sensor signal output by the encoder, which is indicative of the amount of rotation of the print roller, may be supplied to a controller such that the controller can determine the displacement of the label web along the label web path and, consequently, the rate of movement of the label web along the label web path.

In one particular embodiment the encoder which measures the rotation of the print roller comprises a magnet (part number BMN-35H which is marketed by Bomatec, Höri, Switzerland) which is mounted to the end of the print roller such that it co-rotates with the print roller, and an encoder chip (part number AMS5040, marketed by ams R&D UK Ltd) which measures rotation of the magnet and hence print roller, and outputs a signal which is representative thereof. As discussed above, this output can be used by the controller to determine the rate of movement of the label web along the label web path.

Although the encoder in this embodiment measures a rotation of the printer roller in order to output a sensor signal which is indicative of the position of the label web along the label web path (and/or rate of movement of the label web), in other embodiments this need not be the case. Any appropriate encoder which is capable of outputting a sensor signal which is indicative of the position of the label web along the label web path (and/or rate of movement of the label web along the label web path) may be used. For example, an encoder which measures the rotation of a different roller which contacts the label web may be used. In other embodiments an encoder which does not contact the label web may be used.

In other embodiments, the encoder may measure a property of the label web which is periodic in order to provide a sensor signal which is indicative of the position of the label web along the label web path. For example, the encoder may use a label sensor. One type of label sensor is a gap sensor which may be used to measure the amount of electromagnetic radiation (e.g. light) which passes through a portion of the label web (this will be a function of the electromagnetic transmission coefficient of the label web). The label backing web in general has a greater electromagnetic transmission coefficient than a label attached to the label backing web. It follows that, in general, more electromagnetic radiation will pass through a portion of the label web which does not include a label (i.e. a portion of the label web which only includes the label backing web) compared to a portion of the label web which includes both the label backing web and a label attached to the label backing web. Consequently, as the label web advances along the label web path, the gap sensor will measure a periodic property of the label web (I.e. periodic electromagnetic transmission coefficient of the label web). If a pitch length of the labels (i.e. the distance between equivalent portions of adjacent labels) is known by the controller then the controller can use this information to calculate a rate of movement of the label web along the label web path based on the periodic encoder signal. In other embodiments an appropriate label sensor which can measure a periodic property of the label web may be used.

Furthermore, in further embodiments, the rotation of the label supply spool and/or label take up spool may be measured by the encoder, and this information, in combination with knowledge of the diameter of the respective supply spool and/or take up spool may be used to determine the position of the label web along the label web path.

The controller 10 is configured to receive the sensor signal 2*b* which is outputted by the encoder 2*a* and control the first motive apparatus based on the sensor signal. In the embodiment illustrated in FIGS. 1 and 1*a*, the controller 10 is configured to receive the sensor signal 2*b* which is outputted by the encoder 2*a* and control the stepper motor driver 4*a* and hence the stepper motor 4.

In some embodiments, such as that illustrated, in order to advance the label web along the label web path the controller provides a pulsed control signal 10*a* to the first motive apparatus. In the case where the first motive apparatus includes a stepper motor 4 for rotating the label take up spool 3, the pulsed control signal 10*a* provided to the first motive apparatus by the controller 10 may be pulses which trigger a stepper motor drive circuit 4*a* for the stepper motor 4 to advance the stepper motor 4 in a step-wise fashion. The use of stepper motor drive circuits in order to drive stepper motors in a step-wise fashion is well known and hence will not be discussed in any more detail here. Of course, in embodiments in which the first motive apparatus includes two stepper motors, the pulsed control signal provided to the first motive apparatus by the controller may be pulses which trigger a stepper motor drive circuit for each respective stepper motor to advance both the stepper motors in a step-wise fashion.

It will be appreciated that although in the present embodiment the first motive apparatus includes at least one stepper motor, in other embodiments the first motive apparatus may take any appropriate form. For example, the first motive apparatus may include any appropriate number of any appropriate type of motor.

As discussed, a known way for controllers to control certain motors such as stepper motors is for the controller to provide a pulsed control signal to the motor. The nature of the pulsed control signal may be defined by the intervals between each of the pulses. For example a series of intervals between pulses may be a series of different intervals, the length of each interval decreasing as the series advances. A pulsed control signal comprising such a series of intervals between pulses may be used by the controller to accelerate the motor in a desired manner.

For example, in some embodiments, if a controller needs to control the motor so as to effect an acceleration between a first speed and a second speed, the controller may access information stored in a memory which contains data indicative of the series of intervals of the pulsed control signal which corresponds to acceleration between said first speed and said second speed and apply the intervals between pulses stored in the memory so as to achieve the desired acceleration of the motor between the first and second speeds. The data indicative of the series of intervals of the pulsed control signal which corresponds to acceleration between a first speed and a second speed may be referred to as an acceleration table for acceleration between the first speed and the second speed. In some embodiments the controller may not access a stored acceleration table, but given knowledge of the first and second speeds between which acceleration is required, the controller may calculate and implement the required acceleration table for acceleration between the first speed and the second speed.

It will be appreciated that in other embodiments any appropriate method of accelerating a motor (or motors) of the first motive apparatus may be used.

The applicant has realised that in known labelling machines in which the controller controls the first motive apparatus to accelerate the first motive apparatus (and hence label web) to a desired speed, but, in fact the first motive apparatus (and hence label web) is accelerated to a speed which is greater than a desired speed. This may result from the mass and compliance of the system, for example, the mass of the supply spool, the mass of the rewind spool and/or the compliance in the first motive apparatus (e.g. belt linking stepper motor to take up spool support). Once the first motive apparatus has been accelerated, the system may oscillate, such that the rate of movement of the first motive apparatus oscillates. Oscillations in the speed of the label web may make accurate positioning of the label web along the label web path difficult.

In some embodiments a controller 10 may implement a feedback loop whereby the sensor signal 2*b* output by the encoder 2*a* is used to control drive of the first motive apparatus 4 in order to try to advance the label web at a desired speed and/or to a desired position.

In addition, the applicant has realised that in known labelling machines in which the controller controls the first motive apparatus as part of a feedback loop, the controller may provide a control signal to the first motive apparatus to accelerate the first motive apparatus (and hence label web) to a desired speed, but, in fact the first motive apparatus (and hence label web) is accelerated to a speed which is greater than a desired speed. One reason for this may be that there is a delay between signals provided to the first motive apparatus by the controller and resultant acceleration of label web.

If the label web is accelerated to a speed which is greater than the desired speed, it may, in some applications, be disadvantageous. For example, it may then be necessary to decelerate the label web to the desired speed. This can take time, during which the labelling machine is not operating as desired. Furthermore, having to accelerate and then decelerate the label web may lead to oscillations in the speed of the label web which make accurate positioning of the label web along the label web path difficult.

Figure 2:
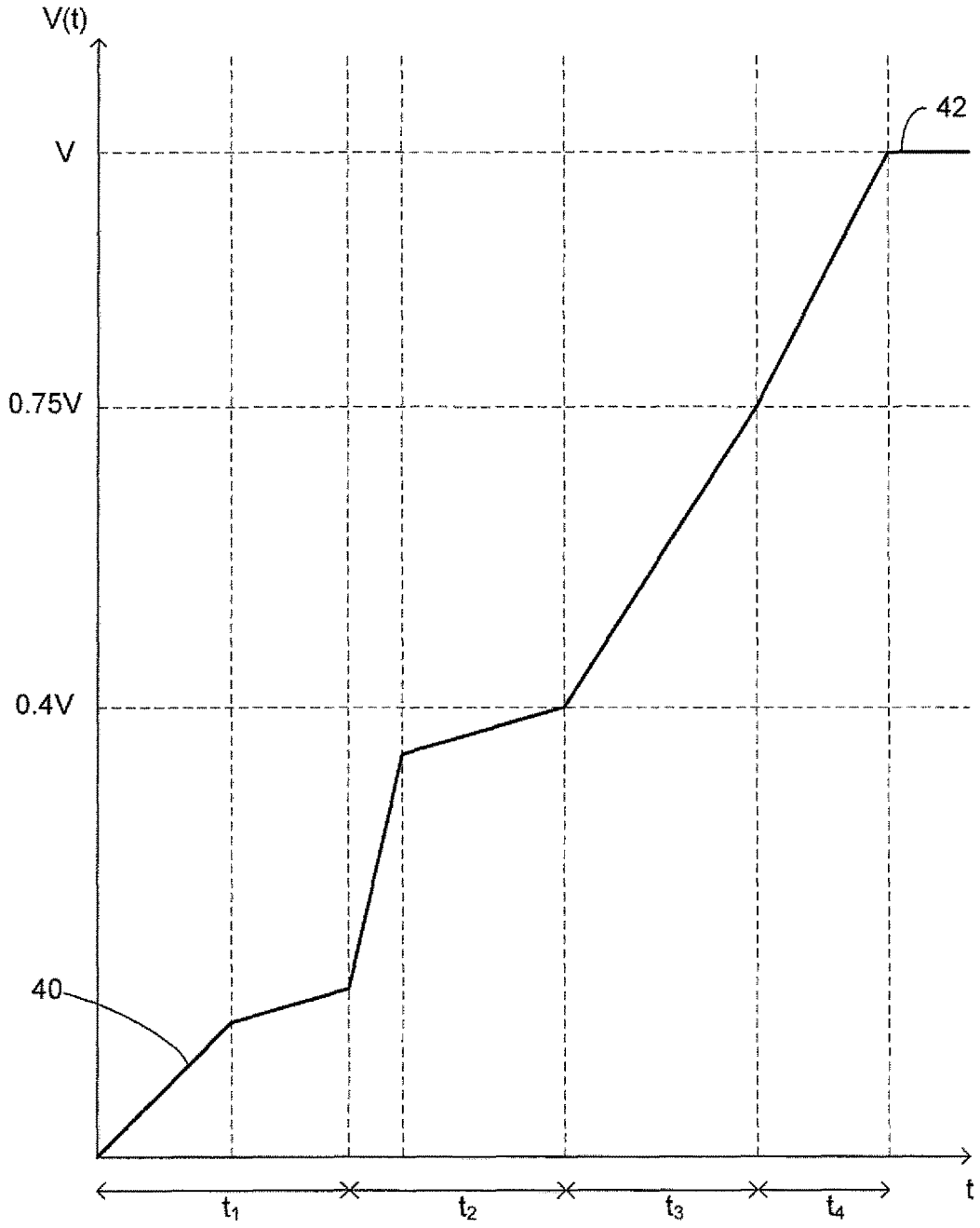
FIG. 2 shows a schematic plot of a speed of a label web as controlled by a controller which forms part of a labelling machine according to an embodiment of the present invention.
Figure 3:
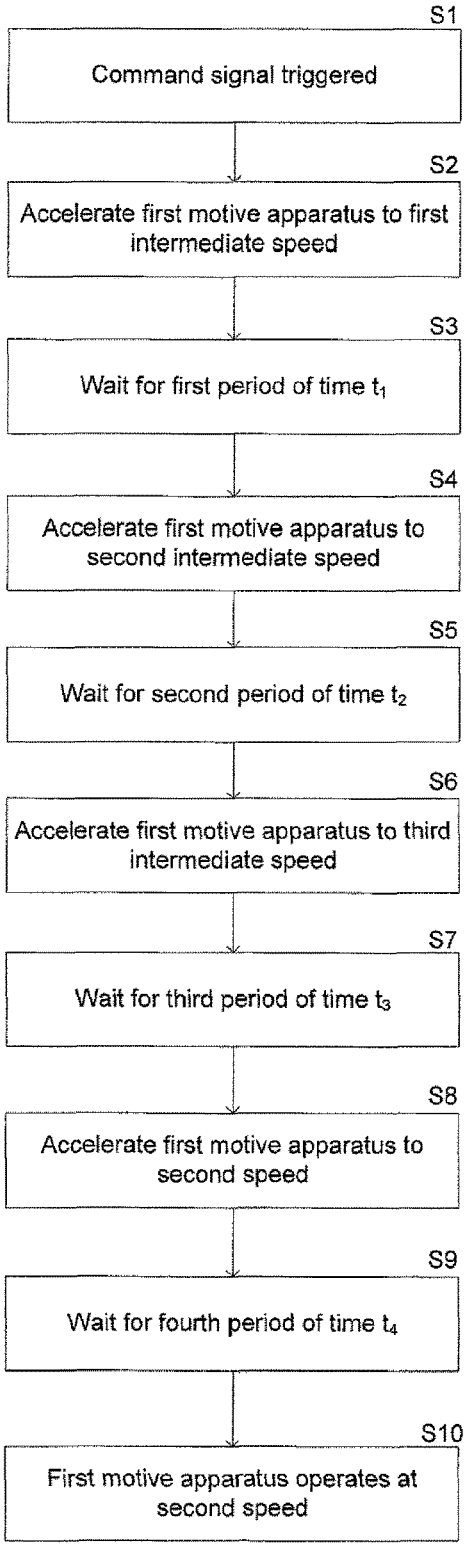
FIGS. 3, 4 and 5 show schematic flow diagrams of steps implemented by controllers according to different aspects of the invention.

FIG. 2 shows a schematic plot of speed of the label web (which may be ascertained using the sensor signal provided by the encoder) against time, for the acceleration of the label web from rest to speed V as controlled by a controller which forms part of a labelling machine according to an embodiment of the present invention. FIG. 3 shows a schematic flow chart which shows the steps of the process implemented by the controller for the acceleration of the label web from rest to speed V as shown in FIG. 2.

The controller 10 is configured such that the controller provides a control signal 10*a* to the first motive apparatus 4 to accelerate the first motive apparatus 4 between a first speed (in this case rest, but which may be any appropriate speed) and a second speed (in this case V, but, again, this may be any appropriate speed) as follows.

In a first step S1 a command signal that acceleration of the label web from rest to speed V is required, is triggered.

The speed V may be determined in any appropriate manner. For example, the speed V may be predetermined and may be stored by the controller or by a memory accessible by a controller. The speed V may correspond to the speed of a passing article to be labelled by the labelling machine. For example, if the passing article to be labelled by the labelling machine is conveyed past the labelling machine on a conveyor, the speed V may be chosen to be the same as the speed of the conveyor. In some applications of labelling machine according to the present invention an encoder may measure the speed of the conveyor. The measured speed of the conveyor may be supplied to the controller so that the controller can set V to be the measured speed of the conveyor.

The command signal (that acceleration of the label web from rest to speed V is required) may be triggered by any appropriate event. For example, in one embodiment, the controller may be provided with a signal from an article sensor. The article sensor is configured to sense the presence of an article to be labelled at a position which indicates that the labelling machine needs to dispense a label in order to label the article sensed by the article sensor. In this embodiment, if the article sensor provides a signal to the controller indicating the presence of an article to be labelled, then the command signal (that acceleration of the label web from rest to speed V is required) is triggered.

At step S2, the controller provides a control signal to the first motive apparatus to command the first motive apparatus to accelerate to a predetermined first intermediate speed intermediate the first speed and second speed. In this case, the control signal is provided to the first motive apparatus to command the first motive apparatus to accelerate to a predetermined first intermediate speed at time t=0. The predetermined first intermediate speed in this case is 20% of the second speed (in this case V).

The controller then waits for a period of time $t_1$ at step S3 during which the control signal provided to the first motive apparatus is such that the controller is attempting to accelerate the first motive apparatus from the first speed (in this case rest) and the first intermediate speed (in this case 20% of the second speed, V). The period of time $t_1$ may be a fixed predetermined time which is known to the controller or may be a time which is defined by another event such as the controller receiving a sensor signal from the encoder that the speed of the label web is a particular speed, or that the label web has advanced a particular distance. In this case, the time is a predefined time, which is about 2 ms.

In some embodiments the initial acceleration as indicated by 40 may be determined by the controller as a function of the first and second speeds between which acceleration of the first motive apparatus is required. In other embodiments the initial acceleration 40 may be predetermined and known by the controller. For example, the initial acceleration 40 may be at a rate of about 50 $mm/s^2$.

After time $t_1$ has passed the controller moves to step S4 and provides a control signal to the first motive apparatus to command the first motive apparatus to accelerate to a second predetermined intermediate speed. The second predetermined intermediate speed is intermediate the first intermediate speed and the second speed. In this case, the second predetermined intermediate speed is about 75% of the second speed V.

The controller provides a control signal to the first motive apparatus in order to command the first motive apparatus to accelerate to the second predetermined intermediate speed for a second period of time $t_2$. Consequently, at step S5 the controller waits for the second period of time $t_2$. Again, the second period of time $t_2$ may be a fixed predetermined time which is known to the controller or may be a time which is defined by another event. Examples of such criteria include when the sensor signal provided by the encoder to the controller is indicative of the label web travelling at a particular speed or when the sensor signal provided by the encoder is indicative of the label web being located at a particular position along the label web path. In the case of the present embodiment, the length of the second period of time $t_2$ is the time between the end of the first time period $t_1$ and the time at which the sensor signal provided by the encoder to the controller is indicative of the label web travelling at a speed which is equal to about 45% of the second speed (in this case V).

In the case of the present embodiment, when the second time period $t_2$ is complete (which in this case occurs when the speed of the label web is about 45% of the second speed V) the controller moves to step S6 and provides a control signal to the first motive apparatus to command the first motive apparatus to accelerate to a third predetermined intermediate speed intermediate the second intermediate speed and the second speed V. In this embodiment, the third intermediate speed is about 95% of the second speed V. The controller controls the first motive apparatus in the manner required to accelerate the first motive apparatus to the third intermediate speed for a third period of time $t_3$. Consequently, at step S7 the controller waits for the third period of time $t_3$. As discussed in relation to the first and second periods of time, the third period of time may be a predetermined time or may be defined by another event. In this case, the period of time $t_3$ is the length of time between the end of the second period of time $t_2$ and the time at which the sensor signal provided by the encoder is indicative of the label web travelling at a speed of about 75% of the second speed V.

After the end of the third time period $t_3$ the controller moves to step S8 and provides a control signal to the first motive apparatus to command the first motive apparatus to accelerate to the second speed V. The controller provides the control signal to the first motive apparatus to command it to accelerate to the second speed V for a fourth period of time $t_4$. Consequently, at step S9 the controller waits for the fourth period of time $t_4$. In other words, the controller provides a control signal to command the first motive apparatus to accelerate to the second speed V. In this embodiment the fourth time period is the length of time between the end of the third time period and the time at which the sensor signal provided to the controller by the encoder is indicative of the label web travelling at a speed which is substantially equal to the second speed V.

At step S10, after the speed of the label web has reached the second speed V (as indicated by the sensor signal provided by the encoder) the controller provides a control signal to the first motive apparatus to maintain the speed of the first motive apparatus (and hence the speed of the label web) at the second speed V. The portion of the motion of the first motive apparatus shown within FIG. 2 which corresponds to the label web travelling at a constant speed (the second speed V) is indicated by 42.

In embodiments in which the first motive apparatus drives the label web along the web path by rotating at least one of the take up spool or supply spool in order to maintain the speed of the label web constant, the controller may need to adjust the speed(s) of the motor(s) as a function of the changing diameters of the take up and/or supply spool. Changing the speed of rotation of motors in order to maintain a constant speed of label web along a label web path is well known to those skilled in the art, and, as such, is not discussed any further.

It can be seen from FIG. 2 that controlling the acceleration of the first motive apparatus between a first speed (rest within the described embodiment) and a second speed (V within the described embodiment) such that the motive apparatus is commanded to accelerate to at least first and second predetermined intermediate speeds before being commanded to accelerate to the second speed, minimises the likelihood that/or extent to which the speed of the label web will overshoot the desired (i.e. second) speed. This may be advantageous because it allows for more accurate positioning of the label web by preventing or minimising any oscillation of label web speed which may occur. In addition, if the labelling machine includes a printer, the printer may only be capable of printing with acceptable print quality up to a particular speed of label web passing the printer. In some known labelling machines the overshoot in label web speed resulting from acceleration of the label web may result in the label web passing the printer at a speed which exceeds the speed up to which the printer can print with acceptable print quality. In such situations, by minimising the likelihood that/or extent to which the speed of the label web will overshoot the desired speed, a labelling machine according to the present invention will minimise the likelihood that/or extent to which the label web speed may exceed the speed up to which the printer can print with acceptable print quality, thereby minimising the likelihood that/or extent to which the print quality of the printer will be adversely affected.

The previously described embodiment includes four separate phases of movement as the first motive apparatus is accelerated between the first and second speeds. These may be referred to as the first phase of movement (steps S2 and S3) during the first time period $t_1$, the second phase of movement (steps S4 and S5) during the second time period $t_2$, the third phase of movement (steps S6 and S7) during the third time period $t_3$ and the fourth phase of movement (steps S8 and S9) during the fourth time period $t_4$. In the described embodiments each of the phases, providing the phase has a preceding phase, immediately follows its preceding phase. Likewise, each of the phases, provided the phase has a subsequent phase, immediately precedes its subsequent phase. In other embodiments this need not be the case. For example, in some embodiments, there may be a time gap between adjacent phases.

The four phases of the acceleration between first and second speeds described above, results from the fact that there are three predetermined intermediate speeds. It is within the scope of the invention for there to be any appropriate number (n) of predetermined intermediate speeds and a corresponding number (n+1) of phases of the acceleration between first and second speeds. However, the applicant has discovered that in order for the invention to be effective at reducing label web speed overshoot, a minimum of two predetermined intermediate speeds is required.

Within the previously described embodiment the predetermined intermediate speeds are defined as a percentage (or proportion) of the second speed (V). In other embodiments, the predetermined intermediate speeds may be determined and/or defined in any appropriate manner provided that the intermediate speeds are between the first and second speeds and provided that each intermediate speed is not less than any preceding intermediate speed.

Furthermore, in the previously described embodiment the first speed is at rest and the second speed is a speed V. In other embodiments the first speed may be a speed which is greater than rest but less than the second speed V. In such embodiments the intermediate speed may alternatively be defined as a desired percentage (or proportion) of the difference between the first and second speeds added to the first speed.

Within the described embodiment the intermediate speeds are such that each intermediate speed is greater than any intermediate speed before it. In other embodiments this need not be the case. In these embodiments the intermediate speeds may be such that at least one intermediate speed may be less than a preceding intermediate speed. Furthermore, in some embodiments, at least one intermediate speed may be less than the first speed. It follows that the intermediate speeds may be any appropriate speed.

Within the previous embodiment the intermediate speeds are defined as speeds of the first motive apparatus which correspond to desired speeds of the label web. For example, in some embodiments, the intermediate speeds may be defined as a rotational speed of a portion of the first motive apparatus which is equivalent to a linear speed of the label web along the label web path. In other embodiments the predetermined intermediate speeds may be defined as desired speeds of the first motive apparatus (without knowledge of the corresponding linear speeds of the label web), and in particular as a particular proportion of a desired speed of the motive apparatus.

It will further be appreciated that not only may the predetermined intermediate speeds be any appropriate intermediate speeds, but also the time period may be defined by a sensor signal indicative of the speed of the label web being equal to any particular appropriate speed being provided to the controller. Any appropriate particular speed may be chosen provided that it is a speed which is between the first and second speeds and that it is a speed which is greater than the label web speed which defines the end of any preceding phase of the acceleration. The speeds may be defined as a percentage (or proportion) of the second speed or may be defined as a percentage (or proportion) of the difference between the first and second speed added to the first speed. In some embodiments, the time period for one or more of the phases of acceleration may be defined by a sensor signal indicative of the speed of the label web being equal to a percentage (or proportion) of the intermediate speed to which the controller is controlling the first motive means to accelerate during that particular phase of acceleration. In the previously described aspect of the invention, where the controller is required to command acceleration of the first motive apparatus between two speeds (for example the first speed and the first intermediate speed) then the controller may utilise an acceleration table for acceleration between the two speeds so as to supply a pulsed control signal to the first motive means which corresponds to acceleration of the first motive means between the two speeds.

As previously discussed, in some applications of labeling machine it is desirable to be able to accurately position the label web along the label web path. This may be advantageous to enable accurate positioning of a label onto an article to which a label is applied and, if the labelling machine includes a printer, ensuring that not only the printer prints on the correct portion of the label, but also ensuring acceptable print quality.

The applicant has discovered that some labelling machines advance label web along the label web path in such a way that lag is introduced between the motive apparatus and the label web. An example of this is given in more detail below.

An example of one type of labelling machine which may result in lag between the motive apparatus which advances the label web and the label web itself is a labelling machine which has a motive apparatus which operates by a motor rotating a take up spool support so as to draw a label web onto the take up spool support to form a take up spool. The winding of label web onto the take up spool support will result in label web being advanced along the label web path.

When advancing the label web, the motor which drives the take up spool support is energised. This causes the take up spool support to be rotated. The rotation of the take up spool support rotates the take up spool. It is thought that the coiled nature of the take up spool means that as the take up spool support is rotated, before the label web is advanced along the label web path, the take up spool becomes more tightly wound.

The labelling machine also includes a label sensor (indicated as 9 in FIG. 1*a*). The label sensor is configured to detect when a particular portion of the label passes. One example of label sensor is a gap sensor. Gap sensors are well known to a person skilled in the art of labelling machines and are used to detect an edge (for example a leading edge) of the labels of the label web which pass the gap sensor. The gap sensor is usually located a fixed distance along the label web path from a target position to which it is desired to advance the edge of each label which is detected by the gap sensor. When the labelling machine is operating, the labelling machine operates so as to try to advance the label web to place the edge of each label of the label web at the target position. This is achieved by the controller of the labelling machine receiving a signal from the gap sensor indicative of the detection of an edge of a label on the label web and the controller controlling the motive apparatus which advances the label web along the label web path so as to advance the label web by the distance between the target position and the gap sensor.

It will be appreciated that in other embodiments any type of label sensor may be used provided it can detect a particular portion of a label of the label web passing it. Whilst a gap sensor may be used to detect an edge of a label of the label web, in other embodiments the label sensor may detect any appropriate particular portion of the label web.

With reference to the lag discussed above, once the motive apparatus driving the take up spool support has caused the take up spool to become more tightly wound and then advanced the label web along the label web path, as the label web is being advanced along the label web path an edge is detected by the gap sensor and the controller controls the motor which drives the take up spool support to rotate the take up spool support by an amount which will cause the label web to advance along the label web path by a distance which is the distance between the gap sensor and the target position.

It has been thought within known label machines that advancing the label web in this manner would result in the edge of the label being positioned correctly at the target position. However, this has been found not to be the case. Without wishing to be bound by theory, the reason for this is thought to be as follows.

Once the first motive apparatus has come to a halt so as to bring the label web (including attached labels) to rest at the target position, it has been found that, despite the fact that no movement is provided to the label web by the first motive apparatus, the label web (including the attached labels), advances some distance along the label web path beyond the target position. It is thought that this additional distance (which may be referred to as the lag distance) moved by the label web along the label web path after the first motive apparatus has come to rest is the result of a lag amount of label web being taken onto the take up spool after the first motive apparatus has come to rest. This may be due to a relaxation of the label web, for example the take up spool becoming less tightly wound.

It will be appreciated that labelling machines in which the label web is advanced and then stopped such that the label web does not end up at a desired target position, but rather at a position which is advanced by some distance from the target position may be disadvantageous in applications of labelling machines in which label position accuracy is important.

An embodiment of the present invention seeks to obviate or mitigate the above problem.

A labelling machine according to an embodiment of the present invention includes a supply spool support 1*a*, take up spool support 3*a* and first motive apparatus 4 as previously discussed (and illustrated in FIGS. 1 and 1*a*). The labelling machine also includes a controller 10 which is configured such that the controller controls the first motive apparatus 4 to advance the web along the web path by a predetermined distance as follows.

Figure 4:
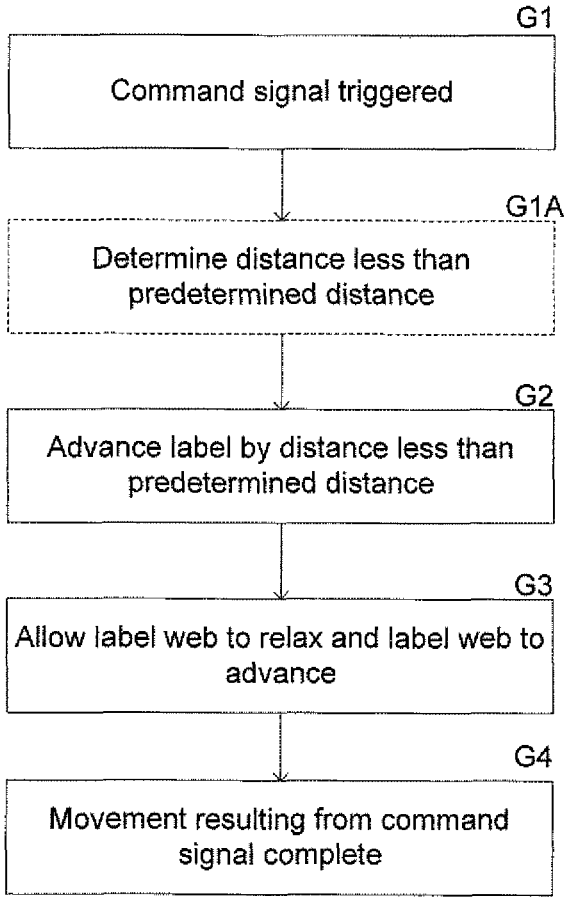

FIG. 4 shows a schematic flow diagram of the steps implemented by a controller of a labelling machine according to this aspect of the present invention.

At step G1 a command signal that the web requires advancement along the web path by the predetermined distance is triggered.

The command signal (that the web requires advancement along the web path by the predetermined distance) may be triggered by any appropriate event. For example, in one embodiment, the controller may be provided with a signal from an article sensor. The article sensor is configured to sense the presence of an article to be labelled at a position which indicates that the labelling machine needs to dispense a label in order to label the article sensed by the article sensor. In this embodiment, if the article sensor provides a signal to the controller indicating the presence of an article to be labelled, then the command signal (that the web requires advancement along the web path by the predetermined distance) is triggered.

In another embodiment the controller may be provided with a signal from a label sensor. The label sensor may be configured to sense the presence of a particular portion of labels of the label web. For example, the label sensor may be configured to sense the presence of an edge (e.g. leading or trailing edge) of labels of the label web. In one embodiment, if the label sensor provides a signal to the controller indicating the presence of a particular portion of a label (e.g. leading or trailing edge) of the label web, then the command signal (that the web requires advancement along the web path by the predetermined distance) is triggered.

At step G2, a control signal is provided to the first motive apparatus which causes the first motive apparatus to advance the label web along the label web path by a distance which is less than the predetermined distance. At step G3, after the web has been advanced along the web path by a distance which is less than the predetermined distance (during step G2), the label web is allowed to relax in order to allow the label web to advance along the web path a further distance. This further distance is thought to result from the lag in the label web as previously discussed.

At step G4 movement of the label web in consequence of the command signal that the web requires advancement along the web path by the predetermined distance is complete.

It will be appreciated that in the ideal case, the controller provides a control signal to the first motive apparatus which causes the first motive apparatus to advance the web along the web path by a distance which is less than the predetermined distance and which is equal to the difference between the predetermined distance and the distance by which the label web will advance when it relaxes (i.e. the lag distance). In this case, a total distance moved by the label web (i.e. sum of the distance moved by the label web due to the first motive apparatus, and the distance moved due to relaxation of the web after the web has been advanced by the first motive apparatus) to be equal to the predetermined distance.

In other embodiments the controller may provide a control signal to the first motive apparatus which causes the first motive apparatus to advance the web along the web path by a distance which is less than the predetermined distance, but is not equal to the difference between the predetermined distance and the lag distance. In such embodiments, the total movement distance of the web along the web path (i.e. the movement distance due to the first motive apparatus plus the movement distance due to a lag) is not equal to the predetermined distance. For example, in some embodiments the total distance by which the label web advances may be greater than the predetermined distance and in other embodiments the total distance by which the label web advances may be less than the predetermined distance.

Provided the total distance the label web is caused to advance along the label web path by a labelling machine according to an embodiment of the present invention is closer to the predetermined distance than would otherwise occur (i.e. if the first motive apparatus was provided with a signal to cause the first motive apparatus to advance the label web by a distance equal to (i.e. not less than) the predetermined distance), then the invention will be advantageous in applications of labelling machine in which accurate positioning of the label web along the label web path is required.

In some embodiments the control signal which is provided to the first apparatus which causes the first motive apparatus to advance the web along the web path by a distance which is less than the predetermined distance may be determined by the controller based on the subtraction of an estimated lag distance from the predetermined distance. The determination of the distance which is less than the predetermined distance by the controller based on subtraction of an estimated lag distance from the predetermined distance is indicated in broken lines in FIG. 4 as step G1A.

The estimated lag distance may be determined in any appropriate manner.

For example, in some embodiments, the estimated lag distance may be an appropriate distance which is input by a user and which is used whatever the operating state of the labelling machine. In other embodiments the controller may determine or select the estimated lag distance based on operating characteristics of the labelling machine. For example, the controller may determine an estimated lag distance based on the diameter of the take up spool and/or a speed at which a label web is advancing along the label web path before it is decelerated. In other embodiments, any appropriate operating characteristics of the labelling machine may be used.

In one embodiment the lag distance is measured empirically for different speeds and diameters of take up spool. This information can then be stored in a memory and accessed by the controller to determine the estimated lag distance for a particular take up spool diameter and/or speed. In general, it has been found that the lag distance increases with increasing take up spool diameter or increasing speed.

It will be appreciated that the label web speed and/or take up spool diameter may be determined in any one of many known ways to determine label web speed and/or take up spool diameter. Consequently, further discussion of determining these operating characteristics of a labelling machine is omitted.

In another embodiment the estimated lag distance may be determined by the controller based on a sensor signal indicative of the position of the label web along the label web path output by an encoder and provided to the controller. An example of a suitable encoder is that which has previously been described which measures rotation of the print roller (e.g. encoder 2*a* shown in FIG. 1*a*). It will be appreciated that, in other embodiments, any appropriate encoder which outputs a sensor signal indicative of the position of the label web along the label web path may be used. In this embodiment the encoder is used to measure the lag distance moved by the label web after the first motive apparatus has come to rest. This measured distance may then be used as the estimated lag distance for a subsequent movement of the label web. In some embodiments the measured lag distances for a succession of movements of the label web (for example the movements of the label web which occur in dispensing a succession of labels) may be averaged in order to determine an estimated lag distance to be used for subsequent movement of the label web.

In order for an encoder to measure the lag distance the encoder must measure the distance moved by the web along the label web path after the first motive apparatus has stopped moving the label web along the label web path. In some embodiments the controller may measure the lag distance by comparing the position of the label web along the web path at the time when the first motive apparatus has come to rest and at a fixed time after this. In some embodiments, this time may be 250 ms. However, in other embodiments, any appropriate time may be used, provided that the time is sufficient for any relaxation of the label web which leads to the lag to occur. In other embodiments, in order for the encoder to measure the lag distance the encoder may measure the total distance moved by the web along the label web path after the command signal that the web requires advancement along the web path by the predetermined distance is triggered. In order to determine the lag distance the controller may wait until a fixed time after the first motive apparatus has come to rest and calculate the difference between the predetermined distance and the distance moved by the label web along the label web path between the time of the triggering of the command signal and the end of the fixed time after the first motive apparatus has come to rest. Again, in some embodiments, the fixed time may be 250 ms. However, in other embodiments, any appropriate time may be used, provided that the time is sufficient for any relaxation of the label web which leads to the lag to occur.

In some embodiments the estimated lag distance may be determined using a combination of the methods above. For example, in one embodiment, the estimated lag distance may initially be determined by the controller based on the diameter of the take up spool and a speed at which a label web is advancing along the label web path before it is decelerated. The estimated lag for a range of speeds and diameters may previously have been measured empirically and stored in a memory, such that the controller can access this memory to determine an estimated lag distance for a particular diameter of take up spool and speed at which the label web is advancing along the label web path before it is decelerated.

After the label web has been commanded to move the predetermined distance (e.g. so as to carry out a labelling operation) using the estimated lag distance determined based on the diameter of take up spool and speed at which the label web is advancing along the label web path before it is decelerated, an encoder may be used as described above to determine the actual lag distance as a result of the label web being commanded to move the predetermined distance. This will enable the controller to determine an estimated lag error, which is the difference between the predetermined distance and the distance moved by the label web along the label web path (using the estimated lag distance) between the time of the triggering of the command signal and the end of the fixed time after the first motive apparatus has come to rest.

The determined estimated lag error may then be added to the estimated lag distance for a next advancement of the web along the web path determined based on the diameter of take up spool and speed at which the label web is advancing along the label web path before it is decelerated in order to arrive at the estimated lag distance for the next advancement of the web along the web path.

In some alternative embodiments, the estimated lag distance for the next advancement of the web along the web path may be carried out as follows. The sum of the estimated lag distance used for the previous advancement of the web and the estimated lag error is divided by the estimated lag distance used for the advancement of the web to arrive at an estimated lag correction factor. The estimated lag distance for the next advancement of the web along the web path is calculated as the estimated lag distance determined based on the diameter of take up spool and speed at which the label web is advancing along the label web path before it is decelerated for the next advancement of the web, multiplied by the estimated lag correction factor.

In some further alternative embodiments, the estimated lag distance for the next advancement of the web along the web path may be carried out as follows.

An estimated lag correction factor CF is determined by the controller according to:

$$CF=((MD-D)+(\mathrm{ELD}-LM))/LM \quad (1)$$

where

MD is distance moved by the label web along the label web path during the previous advancement of the label web (using the estimated lag distance) between the time of the triggering of the command signal and the end of the fixed time after the first motive apparatus has come to rest, D is the predetermined distance for the previous advancement of the web along the web path, ELD is the estimated lag distance used for the previous advancement of the label web, and LM is the estimated lag distance determined based on the diameter of take up spool and speed at which the label web was advanced along the label web path before it was decelerated during the previous advancement of the web.

The estimated lag distance for the next advancement of the web along the web path is calculated as the estimated lag distance determined based on the diameter of take up spool and speed at which the label web is advancing along the label web path before it is decelerated for the next advancement of the web, multiplied by one plus the estimated lag correction factor. In some embodiments, the estimated lag error or estimated lag correction factor may be averaged over a number of preceding label web advancements (e.g. 8, but any appropriate number may be used) before they are used in order to calculate the estimated lag distance for a next advancement of the web along the web path.

In some applications of labelling machine it is desirable that after a label has been dispensed by a labelling machine and the label web has come to rest, the label web is located at a particular position along the label web path. For example, after a label has been dispensed by the labelling machine (i.e. the label web has been accelerated and advanced by the first motive apparatus such that a label has been removed from the label web by the labelling peel beak (or other suitable device for removing a label from the label web) and then the label web has been decelerated to rest) it may be desirable for the label web to come to rest at a desired position along the label web path, such as a position at which a leading edge of the next label to be dispensed is substantially aligned with the edge of the labelling peel beak. It will be appreciated that in other embodiments, the desired position of the label web along the label web path when the label web has come to rest may be any appropriate position.

As previously discussed above, there may be lag present within a labelling machine such that after the first motive apparatus which advances the label web along the label web path has come to rest, the label web may continue to move. Consequently, the label web may not stop at the desired position along the label web path. Whilst the lag distance (i.e. the distance moved by the label web along the label web path due to lag) is fairly consistent between adjacent labels, the exact amount of lag distance for the movement of the label web required to dispense a label shows some variation. Because of this, it is not possible to reliably locate the label web along the label web path by using a gap sensor (as previously discussed) to position the label web (and hence labels of the label web) at a desired position along the label web path.

In applications of a labelling machine in which users are accustomed to seeing the label web stop at desired position along the label web path (e.g. a leading edge of the next label to be dispensed being substantially aligned with the edge of the labelling peel beak) after the labelling machine has performed a labelling operation in order to confirm that the labelling machine is operating in a satisfactory manner, then the inability to reliably locate the label web along the label web path after a labelling operation may be undesirable. Furthermore, if the label web comes to rest at a position before (i.e. upstream of) the desired position along the web path then the label web will have to be advanced further during a subsequent labelling operation, which may result in the subsequent labelling operation taking longer to complete. In addition, the inability to reliably locate the label web along the label web path means that the movement the label web has to undergo for each labelling operation is unpredictable.

An embodiment of the present invention seeks to obviate or mitigate this problem.

Accordingly, this embodiment of the invention includes a supply spool 1, a take up spool 2 and a first motive apparatus 4 as previously discussed (for example, in relation to FIGS. 1 and 1*a*). A labelling machine according to this embodiment also includes an encoder 2*a* configured to produce a sensor signal 2*b* indicative of the position of the label web along the web path. As previously discussed the encoder may be of any appropriate type of capable of producing a sensor signal indicative of the position of the label web along the label web path.

The labelling machine also includes a controller 10 configured to provide a control signal 10*a* to the first motive apparatus 4.

Figure 5:
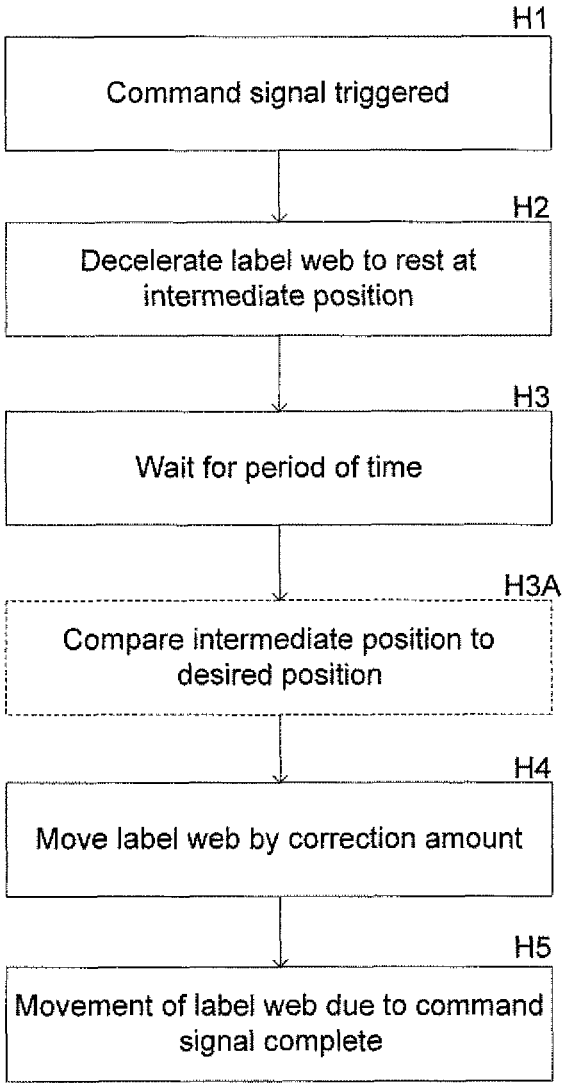

FIG. 5 shows a schematic flow diagram of the steps implemented by a controller of a labelling machine according to this aspect of the present invention.

The controller is configured such that at step H1 a command signal is triggered that commands the first motive apparatus to decelerate the label web from a first speed to rest such that the web stops at a desired position along the web path.

The command signal (that the first motive apparatus should decelerate the label web from a first speed to rest such that the web stops at a desired position along the web path) may be triggered by any appropriate event. For example, in one embodiment, the controller may be provided with a signal from a label sensor. The label sensor may be configured to sense the presence of a particular portion of labels of the label web. For example, the label sensor may be configured to sense the presence of an edge (e.g. leading edge or trailing edge) of labels of the label web. In one embodiment, if the label sensor provides a signal to the controller indicating the presence of a particular portion of a label (e.g. leading edge or trailing edge) of the label web, then the command signal (that the first motive apparatus should decelerate the label web from a first speed to rest such that the web stops at a desired position along the web path) may be triggered.

The controller achieves this by, at step H2, providing a control signal to the first motive apparatus to decelerate the first motive apparatus between the first speed and rest such that the label web is brought to rest by the first motive apparatus at an intermediate position along the web path. The controller then waits a period of time at step H3. The time period is chosen in order to enable any movement of the label web along the label web path due to lag to be completed. The time period that the controller is configured to wait may be any appropriate time. In some embodiments the time that the controller waits may be about 250 ms. After the controller has waited the previously discussed period of time in step H3, then, based on a sensor signal produced by the encoder and provided to the controller, at step H4, the controller provides a control signal to the first motive apparatus to move the web along the web path by a correction amount to position the label web (and hence labels of the label web) at the desired position along the web path.

At step H5 movement of the label web in consequence of the command signal that the web requires advancement along the web path by the predetermined distance is complete.

From the above it will be apparent that before step H4 the controller uses the encoder to determine the position of the label web along the label web path at the intermediate position and compare this to the desired position of the label web along the label web path. This is indicated in broken lines as step H3A within FIG. 5. The controller then determines the movement required in step H4 in order to locate the label web at the desired position along the label web path and during step H4 provides a control signal to the first motive apparatus in order to move the label web along the label web path from the intermediate position to the desired position.

In some embodiments the difference between the intermediate position of the label web along the label web path and the desired position is determined at step H3A as follows. In some embodiments the controller may be aware of the distance the label web has to travel along the label web path in order for the label web to arrive at the desired position. For example, if an edge of the label web is detected by a gap sensor at a particular time, then the controller may know that at that given time, the label web has to advance a particular distance (for example the distance between the gap sensor and the edge of the labelling peel beak) in order for the label web to arrive at the desired position. The controller monitors the sensor signal produced by the encoder in order to determine the distance along the web path the label web moves whilst it is advanced to the intermediate position and also measures any further advancement of the label web along the label web path due to lag. This is the distance moved by the label web along the label web path between the given time (time at which the edge of the label passes a gap sensor) and at the time after the controller has waited for the previously described period of time in order to allow for any movement of the label web along the label web path due to lag. The difference between the distance which the label web should have been advanced from the time at which the edge of the label was detected by the gap sensor in order to reach the predetermined position of the label web along the label web path, and the distance travelled by the label web along the label web path as the label web moves to the intermediate position and then advances any further distance due to label web lag is then determined by the controller. This is the distance that the controller uses to provide a control signal to the first motive apparatus to move the web along the web path by the correction amount so as to position the web at the desired position along the web path.

The correction amount may be an amount which requires that the label web is advanced (i.e. moved forward) of the web along the web path in order to position the web at the desired position along the label web path. In other cases, the correction amount may amount that requires that the label web retreats (i.e. moved backward) in order to be positioned at the desired position along the web path. As such, the correction amount may have a positive or negative value, where positive values are associated with label web advancement and negative values are associated with label web retreat or vice-versa. The label web may be moved by the first motive apparatus in any appropriate manner in order to cause the label web to retreat along the label web path if required. The embodiment of labelling machine according to the present invention shown in FIG. 1 includes a spring biased dancing arm D including a roller which defines a portion of the label web path because the label web moves around the roller of the dancing arm. The dancing arm is biased in a direction in which the dancing arm increases the path length distance between the takeup spool and supply spool. As such, if the takeup spool is rotated in the opposite direction to that required to draw label web on to the take up spool, the dancing arm will pull a portion of the label web along the web path such that the label web retreats along the label web path.

The speed at which the first motive apparatus moves the web along the web path by the correction amount in step H4 in order that the label web reaches the desired position may be a relatively slow speed, for example 25 millimetres per second. The controller may control the first motive apparatus to advance the web along the web path by the correction amount at any appropriate speed provided that it is slow enough that any label lag which may occur as a result of the movement of the label web along the label web path by the correction amount is minimised or such that there is no lag. It has been found by the applicant that the slower the speed at which the label web is advanced before being decelerated to rest, the less movement of the label web along the label web path after the motive apparatus has come to rest due to lag occurs.

In some embodiments the intermediate position is a predetermined distance along the label web path relative to the desired position. For example, in some embodiments the intermediate position is 0.5 millimetres upstream (i.e. before) the desired position. In other embodiments any appropriate intermediate position or method of determining the intermediate position may be used.

In some embodiments, if the labelling machine is operating at a high throughput speed such that a subsequent labelling operation is requested prior to the correction amount of advancement of the label web along the label web path being conducted by the first motive apparatus, the controller may control the first motive apparatus so as to not carry out the movement required to effect movement of the label web along the label web path by the correction amount. Instead the determined correction amount may be added to the movement required by the label web for the subsequent labelling operation. In this way the label web is advanced along the label web path during the subsequent labelling operation by a distance such that the subsequent label is correctly dispensed (e.g. such that the label is applied to a correct portion of a product passing the label machine).

In some embodiments, if a subsequent labelling operation is requested during the correction amount of advancement of the label web along the label web path being conducted by the first motive apparatus, the controller may control the first motive apparatus so as to, at the time the subsequent labelling operation is requested, stop carrying out the correction amount of advancement. The remaining portion of the correction amount at the time when the correction amount of advancement is stopped due to a subsequent labelling operation being requested may be added to the movement required by the label web for the subsequent labelling operation. Again, in this way the label web is advanced along the label web path during the subsequent labelling operation by a distance such that the subsequent label is correctly dispensed (e.g. such that the label is applied to a correct portion of an article passing the label machine).

In some embodiments the labelling machine is mounted adjacent to a conveying device (such as, but not limited to, a conveyor belt). The labelling machine and conveying device are arranged relative to one another such that the labelling machine may apply labels to products transported to the labelling machine by the conveying device. Operation of the labelling machine so as to dispense a label is normally initiated by a product sensor being triggered indicating that a product to be labelled is present (for example, in some cases, that a product to be labelled is approaching the labelling machine on the conveying device).

In some embodiments the controller is programmed with a so-called "registration delay". Such a registration delay can indicate a time which should elapse (monitored by a simple timer) after detection of the product by the product sensor before the labelling process begins, or alternatively indicate a distance through which the conveying device should move (as monitored by an encoder for measuring the distance moved by the conveying device) before the labelling process begins. The registration delay may be input to the controller by an operator of the labelling machine. It will be appreciated that by adjusting the registration delay, the position on a passing product at which a label is affixed may be adjusted.

The mounting of a labelling machine adjacent to a conveying device and the use of a product sensor and registration delay to ensure that labelling operations are carried out at a correct time to ensure that labels are applied to a correct portion of products passing the label machine is well known to those skilled in the art and is consequently not discussed in any further detail.

In some embodiments the registration delay may be modified for a subsequent labelling operation in the situation where the subsequent labelling operation has been requested prior to (or during) the correction amount of advancement of the label web along the label web path being conducted by the first motive apparatus for the labelling operation prior to the subsequent labelling operation.

As previously discussed, in the situation where a subsequent labelling operation is requested prior to the correction amount of advancement being conducted, the determined correction amount may be added to the movement required by the label web for the subsequent labelling operation. In this situation the registration delay may be modified (e.g. from a conventional value which is utilised when there is no correction amount of advancement added to the movement required by the label web for the subsequent labelling operation), such that the registration delay is reduced by a time equivalent to that required for the label web and/or conveying device to move the determined correction amount during said subsequent labelling operation. Alternatively the registration delay may be reduced by a distance through which the conveying device will move (as monitored by said encoder for measuring the distance moved by the conveying device) equivalent to the determined correction amount.

Again, as previously discussed, in the situation where a subsequent labelling operation is requested during the correction amount of advancement being conducted, the remaining portion of the correction amount at the time when the correction amount of advancement is stopped (due to the subsequent labelling operation being requested) may be added to the movement required by the label web for the subsequent labelling operation. In this situation (e.g. in the situation in which the remaining portion of the correction amount at the time when the correction amount of advancement is stopped is added to the movement required by the label web for the subsequent labelling operation), the registration delay may be modified (e.g. from a conventional value which is utilised when there is no correction amount of advancement added to the movement required by the label web for the subsequent labelling operation), such that the registration delay is reduced by a time equivalent to that required for the label web and/or conveying device to move the remaining portion of the correction amount. Alternatively, the registration delay may be reduced by a distance through which the conveying device should move (as monitored by said encoder for measuring the distance moved by the conveying device) equivalent to the remaining portion of the correction amount.

It will be appreciated that some embodiments of the invention may combine various aspects of the invention discussed above.

For example, some embodiments of the invention require that the motive apparatus is controlled so as to decelerate the first motive apparatus between the first speed and rest such that the label web is brought to rest by the first motive apparatus at an intermediate position along the web path. The controller then waits. After the controller has waited, based on a sensor signal produced by an encoder, the controller provides a control signal to the first motive apparatus to move the web along the web path by a correction amount to position the label web (and hence labels of the label web) at a desired position along the web path.

In other embodiments of the invention the controller controls the first motive apparatus to advance the web along the web path a predetermined distance by providing a control signal to the first motive apparatus which causes the first motive apparatus to advance the web along the web path by a distance which is less than the predetermined distance and wherein relaxation of the web after the web has been advanced along the web path by the first motive apparatus results in the web advancing along the web path a further distance.

An embodiment of the invention which combines the two previous embodiments is one in which the predetermined distance advanced in the second embodiment results in the label web being positioned at the desired position along the web path of the first embodiment. The distance advanced by the label web in the second embodiment (i.e. the sum of the distance which is less than the predetermined distance and the further distance due to web relaxation) may result in the web being located at the intermediate position along the web path as in the first embodiment. As such, in such a combination of aspects of the invention, the label web is advanced from the intermediate position, by the correction amount, to the desired position which corresponds to the predetermined distance. The predetermined distance may be a distance the label web moves during a labelling operation.

Various features of the labelling machine have been described above. In some cases, exemplary components, configurations and methods suitable for realising these particular features have been described. However in many cases the skilled person will know of other components, configurations and methods which can similarly be used to realise the particular features which are described. Many of these components, configurations and methods will be known to the skilled person from the common general knowledge. It is envisaged that such alternative components, configurations and methods can be implemented in the described embodiments without difficulty given the disclosure presented herein.

Although the described embodiments include a printer (i.e. relate to print and apply labelling machines), it will be appreciated that the invention may equally be applied to a labelling machine which does not include a printer.

While references have been made herein to a controller or controllers it will be appreciated that control functionality described herein can be provided by one or more controllers. Such controllers can take any suitable form. For example control may be provided by one or more appropriately programmed microprocessors (having associated storage for program code, such storage including volatile and/or non volatile storage). Alternatively or additionally control may be provided by other control hardware such as, but not limited to, application specific integrated circuits (ASICs) and/or one or more appropriately configured field programmable gate arrays (FPGAs).

Where angles have been specified herein, such angles are measured in radians although modifications to use other angular measurements will be apparent to the skilled person.

While various embodiments of labelling machine(s) have been described herein, it will be appreciated that this description is in all respects illustrative, not restrictive. Various modifications will be apparent to the skilled person without departing from the spirit and scope of the invention.

The invention claimed is:

1. A labelling machine comprising:

a supply spool support for supporting a spool of label carrying web, a take up spool support adapted to take up a portion of web, and a first motive apparatus for transporting web along a web path between the supply spool support to the take up spool support, a controller configured to provide a control signal to the first motive apparatus, wherein the controller is further configured such that the controller provides a control signal to the first motive apparatus to accelerate the first motive apparatus between a first speed and a second speed by providing a control signal to the first motive apparatus to command the first motive apparatus to accelerate to a predetermined first intermediate speed intermediate the first and second speeds, then a control signal to command the first motive apparatus to accelerate to a second predetermined intermediate speed intermediate the first intermediate speed and the second speed, and then a control signal to command the first motive apparatus to accelerate to the second speed; and, wherein the predetermined first and second intermediate speeds are discrete relative to each other and each is discrete relative to the first speed and second speed.

2. A labelling machine according to claim 1, wherein the controller is configured to command the first motive apparatus to accelerate to the first intermediate speed for a first time period, the controller is configured to command the first motive apparatus to accelerate to the second intermediate speed for a second time period, and the controller is configured to command the first motive apparatus to accelerate to the second speed for a third time period.

3. A labelling machine according to claim 1, wherein the first and second predetermined intermediate speeds are defined as a proportion of the second speed.

4. A labelling machine according to claim 1, wherein the first and second intermediate speeds are defined as the first speed plus a proportion of the difference between the first and second speeds.

5. A labelling machine according to claim 2, wherein the first time period and/or second time period is a predetermined time.

6. A labelling machine according to claim 2, wherein the labelling machine further includes an encoder configured to produce a sensor signal indicative of the speed of the label web along the web path, and wherein the first time period and/or second time period and/or third time period is ended when the controller receives a sensor signal from the encoder that indicates that the speed of the label web is a respective predetermined speed.

7. A labelling machine according to claim 6, wherein the encoder is configured to monitor rotation of a roller which defines a portion of the label web path.

8. A labelling machine according to claim 7, wherein the labelling machine includes printer comprising a printhead which is configured to press the label web against a print roller to effect printing, and wherein the encoder is configured to monitor the rotation of the print roller.

9. A labelling machine according to claim 6, wherein the respective predetermined speed is defined as a proportion of the second speed.

10. A labelling machine according to claim 6, wherein the respective predetermined speed is defined as the first speed plus a proportion of the difference between the first and second speeds.

11. A labelling machine according to claim 2, wherein the acceleration during the first time period and/or the second time period and/or the third time period is a predetermined acceleration.

12. A labelling machine according to claim 2, wherein the acceleration during the first time period is determined by the controller based on the first speed and the first intermediate speed.

13. A labelling machine according to claim 2, wherein the acceleration during the second time period is determined by the controller based on the first intermediate speed and the second intermediate speed.

14. A labelling machine according to claim 2, wherein the acceleration during the second time period is determined by the controller based on the first intermediate speed and the second intermediate speed.

15. A method of controlling a labelling machine, the labelling machine comprising a supply spool support, a take up spool support, a first motive apparatus and a controller, the method comprising:

the supply spool support supporting a spool of label carrying web, the take up spool support taking up a portion of the web, the first motive apparatus transporting web along a web path between the supply spool support to the take up spool support, the controller providing a control signal to the first motive apparatus to accelerate the first motive apparatus between a first speed and a second speed by: providing a control signal to the first motive apparatus to command the first motive apparatus to accelerate to a predetermined first intermediate speed intermediate the first and second speeds, then providing a control signal to command the first motive apparatus to accelerate to a second predetermined intermediate speed intermediate the first intermediate speed and the second speed, and then providing a control signal to command the first motive apparatus to accelerate to the second speed; and, wherein the predetermined first and second intermediate speeds are discrete relative to each other and each is discrete relative to the first speed and second speed.

16. A non-transitory computer readable medium carrying processor readable instructions operable to cause a processor to carry out the operations of:

providing a control signal to a first motive apparatus to accelerate the first motive apparatus between a first speed and a second speed by: providing a control signal to the first motive apparatus to command the first motive apparatus to accelerate to a predetermined first intermediate speed intermediate the first and second speeds, then providing a control signal to command the first motive apparatus to accelerate to a second predetermined intermediate speed intermediate the first intermediate speed and the second speed, and then providing a control signal to command the first motive apparatus to accelerate to the second speed;

wherein the first motive apparatus is configured to transport a web along a web path between a spool support of a labelling machine, supporting a spool of the web, to a take up spool support of a labelling machine, taking up a portion of the web; and, wherein the predetermined first and second intermediate speeds are discrete relative to each other and each is discrete relative to the first speed and second speed.

* * * * *